United States Patent [19]

Peters et al.

[11] Patent Number: 4,464,880

[45] Date of Patent: Aug. 14, 1984

[54] METHOD AND APPARATUS FOR INTRODUCING STACKS OF SHEETS INTO PREFABRICATED CARTONS OR THE LIKE

[75] Inventors: Hartmut Peters; Hulusi Yilmaz, both of Hamburg, Fed. Rep. of Germany

[73] Assignee: E. C. H. Will (GmbH & Co.), Hamburg, Fed. Rep. of Germany

[21] Appl. No.: 463,014

[22] Filed: Feb. 1, 1983

Related U.S. Application Data

[63] Continuation of Ser. No. 192,444, Sep. 30, 1980, abandoned.

[30] Foreign Application Priority Data

Oct. 6, 1979 [DE] Fed. Rep. of Germany ..... 2940600

[51] Int. Cl.[3] ..... B65B 5/06; B65B 25/14

[52] U.S. Cl. ..... 53/493; 53/259; 53/260; 53/468; 53/566

[58] Field of Search ..... 53/493, 52, 566, 469, 53/467, 473, 458, 260, 251, 250, 249, 259; 414/903, 48; 198/812; 271/189

[56] References Cited

U.S. PATENT DOCUMENTS

| | | | |
|---|---|---|---|
| 2,320,934 | 1/1943 | James et al. | 198/448 |
| 2,521,196 | 9/1950 | Whetzell | 53/260 |
| 2,940,616 | 6/1960 | Reed | 414/903 X |
| 3,099,906 | 8/1963 | McCabe et al. | 53/493 |
| 3,106,048 | 10/1963 | Marasso et al. | 53/249 X |
| 3,619,969 | 11/1971 | Holcombe | 53/570 |
| 3,952,887 | 4/1976 | Lutz | 414/392 |
| 3,960,374 | 6/1976 | Gaffney | 271/189 |
| 4,104,847 | 8/1978 | Glandon et al. | 53/570 X |
| 4,151,906 | 5/1979 | Pfeiffer et al. | 198/812 X |
| 4,219,989 | 9/1980 | Andrews | 53/572 |

FOREIGN PATENT DOCUMENTS

| | | | |
|---|---|---|---|
| 870042 | 6/1961 | United Kingdom . | |
| 1208606 | 10/1970 | United Kingdom | 53/251 |

*Primary Examiner*—James F. Coan

*Attorney, Agent, or Firm*—Peter K. Kontler

[57] ABSTRACT

Stacks of paper sheets are delivered onto the upper reach of an endless conveyor or onto the upper side of a platform which is movable through an open side and into the interior of a carton at a carton filling station. The open side of the carton is closed, by pivoting the corresponding side wall upwardly from a level at or below the level of the bottom wall of the carton, upon completion of insertion of a stack.

37 Claims, 10 Drawing Figures

METHOD AND APPARATUS FOR INTRODUCING STACKS OF SHEETS INTO PREFABRICATED CARTONS OR THE LIKE

This application is a continuation, of application Ser. No. 192,444, filed Sept. 30, 1980 now abandoned.

CROSS-REFERENCE TO RELATED APPLICATION

An apparatus which is similar to one of the apparatus described and shown in the present case is disclosed in the commonly owned copending application Ser. No. 192,422 filed Sept. 30, 1980 by Hulusi Yilmaz for "Apparatus for introducing stacks of sheets into cartons or the like".

BACKGROUND OF THE INVENTION

The present invention relates to a method and apparatus for manipulating stacks of paper sheets or the like, and more particularly to improvements in a method and apparatus for introducing stacks of normally flexible sheets into prefabricated cartons or other types of receptacles. Still more particularly, the invention relates to improvements in a method and apparatus for introducing successive stacks of a series of stacks into successive receptacles of a series of receptacles while the receptacle which is about to receive a stack dwells in or close to a predetermined position, i.e., at a predetermined location.

It is well known to fill receptacles (e.g., cardboard boxes of the type known as cartons) with sheets of paper or the like by accumulating the sheets into stacks which are thereupon delivered to a carton filling station and dropped into the respective receptacles. Thus, each stack is advanced to a position of register with the open top of a receptacle and is thereupon caused or allowed to descend by gravity so as to enter the receptacle therebelow. The freshly filled receptacle is removed from the predetermined position, provided with a cover or lid, and transported to storage or to a further processing station. Successive empty receptacles are delivered by a first conveyor, and the stacks are delivered by a second conveyor whose discharge end is located at a level above a portion of the path which is defined by the first conveyor. The stack which reaches the position of registry with a carton therebelow is supported by a platform which is removable so that the stack can descend by gravity to drop into the carton therebelow. The platform may consist of or may include two flaps which are pivotable between substantially horizontal positions to support a stack from below and second positions in which they extend downwardly. Alternatively, the flaps can be retracted laterally so that the stack can descend therebetween. Reference may be had to German Offenlegungsschrift No. 2,756,473 which discloses laterally shiftable flaps. Once a stack has been allowed to descend by gravity, the flaps return to their operative (intercepting) positions to support the next-following (oncoming) stack, and the freshly filled carton below the flaps is replaced with an empty carton.

A drawback of the just outlined conventional methods and apparatus is that the stacks must be delivered to a location other than the receptacles prior to actual introduction into the receptacles. This takes up substantial amounts of time ad necessitates resort to additional equipment, such as the aforementioned platform with laterally retractable or downwardly pivotable flaps, panels or like components. Moreover, gravitational descent of stacks into cartons or analogous receptacles through the open tops of the receptacles invariably involves the danger of misalignment of stacks or certain sheets of stacks during descent into the receptacles therebelow, shifting of one or more layers of the stacks with reference to the remaining layer or layers, and/or damage to or deformation of the receptacles. The likelihood of damage to the stacks, to the receptacles, to stacks and receptacles and/or shifting of some layers or sheets of a stack relative to the other layers or sheets is especially pronounced when the stacks are to be introduced into receptacles whose dimensions practically match or only slightly exceed the dimensions of the respective stacks. It is quite customary to utilize receptacles in the form of thin-walled and therefore relatively unstable cartons which are likely to undergo deformation, either during transport to a position below a stack which is about to descend and/or during introduction of the stack by gravity, if the stack is not in exact register with the carton therebelow. Bulging of side walls of a carton which is open at the top causes the corners of such carton to move inwardly and to be located in the path of a descending stack. The stack is incapable of entering the thus deformed carton and causes additional deformation of the carton as a result of impingement of its lowermost sheet or sheets against the inwardly drawn corners.

Additional problems arise in connection with the manipulation of stacks which are assembled of large or very large sheets. Such stacks are especially likely to be deformed during gravitational descent into the receptacles therebelow. The deformation normally entails at least some shifting of the upper layer or layers relative to the lower layer or layers and/or vice versa. The likelihood of shifting of layers relative to each other is even more pronounced when the stacks are assembled of lightweight sheets.

OBJECTS AND SUMMARY OF THE INVENTION

An object of the invention is to provide a novel and improved method of introducing stacks of flexible paper sheets or the like into prefabricated cartons or analogous receptacles in such a way that the step of causing or allowing the stacks to descend by gravity can be disposed with.

Another object of the invention is to provide a method of the just outlined character which ensures that the stacks are not likely to be defaced or otherwise damaged or deformed during introduction into the respective receptacles regardless of whether the stacks are assembled of small, medium-sized, large or very large sheets.

A further object of the invention is to provide a novel method of filling receptacles with stacks which are assembled of lightweight sheets without risking damage to or deformation of discrete sheets or groups of sheets.

An additional object of the invention is to provide a method which is simpler and more reliable than heretofore known methods, and which renders it possible to fill receptacles with stacks at a frequency that cannot be achieved by resorting to conventional methods.

Another object of the invention is to provide a novel and improved apparatus for the practice of the above outlined method.

A further object of the invention is to provide an apparatus which is simpler and more compact than heretofore known apparatus, whose output exceeds the output of heretofore known apparatus, and which can automatically fill cartons or analogous receptacles with stacks of superimposed paper sheets or the like even if the receptacles are not in optimum positions for reception of stacks and/or even if the receptacles are slightly deformed at the time they are in the process of receiving the stacks.

An additional object of the invention is to provide an apparatus which is less prone to malfunction than heretofore known apparatus, which is more compact and comprises fewer parts than conventional apparatus, and which can be installed in many existing production lines as a superior substitute for apparatus which are presently used to introduce stacks of paper sheets or the like into prefabricated cardboard boxes or analogous receptacles.

One feature of the invention resides in the provision of a method of introducing stacks of paper sheets or the like into cartons or analogous receptacles of the type having a bottom wall and several (normally three) upstanding side walls which define an opening extending all the way or at least close to the respective bottom wall. The method comprises the steps of advancing successive receptacles of a series of receptacles to a predetermined location (for example, the receptacles can be advanced along a predetermined path and the predetermined location can constitute a portion of such path), feeding a stack into the receptacle at the predetermined location including introducing such stack through the opening of the respective receptacle (i.e., not by dropping the stack into the receptacle from above), and thereupon closing the freshly filled receptacle, either at the predetermined location or subsequent to removal of such freshly filled receptacle from the predetermined location.

In accordance with a presently preferred embodiment of the invention, the feeding step includes depositing each stack on the bottom wall of the respective receptacle at least substantially without any gravitational descent of the stack toward the bottom wall. Thus, and as already mentioned above, the stacks are not dropped into the receptacles from above but are delivered along a path which is parallel with and close to the upper side of the bottom wall and extends through the aforementioned opening of the respective receptacle.

The receptacles are preferably of the type having three upstanding side walls (i.e., three side walls which extend upwardly and above the normally horizontal bottom wall) and a fourth side wall which is located at the level of or below the bottom wall prior to feeding of a stack into the receptacle. The opening is located above the fourth side wall and the closing step then includes pivoting or otherwise moving the fourth wall upwardly upon completion of the feeding step so that the fourth side wall closes the opening and cooperates with the other three side walls to confine all four sides of the stack which rests on the bottom wall.

The receptacles may constitute converted flat blanks made of cardboard or the like. The converting step includes pivoting three of normally four side walls to one side of the bottom wall (which constitutes the central portion of the flat blank) and leaving the fourth side wall in the plane of the bottom wall, or pivoting the fourth side wall to the other side of the bottom wall. The just discussed converting step precedes the advancing step, and the latter includes positioning successive prefabricated receptacles at the predetermined location and in such orientation that the bottom walls of the receptacles are located in or substantially in horizontal planes. The closing step can be preceded by the step of removing filled receptacles from the predetermined location, i.e., it is not necessary to confine all four sides of a freshly introduced stack before the respective filled receptacle leaves the predetermined location. The blanks are preferably creased, perforated or otherwise weakened in the regions between the bottom walls and the respective fourth side walls to facilitate pivoting of each fourth side wall to the other side of the respective bottom wall and/or to the position in which such fourth side wwall closes the respective opening. The fourth side wall of each receptacle can be held against movement beyond the position of coplanarity with or at the other side of the bottom wall while a receptacle is advanced toward or dwells at the predetermined location. This ensures that the fourth side walls cannot obstruct the introduction of stacks by way of the respective openings. The fourth side walls can be moved to positions in which they close the respective openings in automatic response to removal of filled receptacles from the predetermined location. This can be readily achieved by resorting to a suitable cam which pivots the fourth side wall of a freshly filled receptacle while the latter is caused to advance from the predetermined location toward the next station, e.g., to a station where the open top of the receptacle is closed by a suitable cover or lid.

The paths for the receptacle and for the stacks are preferably but need not always be horizontal. All that counts is to ensure that the discharge end of the path for the stacks is at the level of the opening of a receptacle at the predetermined location so that the stack can readily enter such receptacle and its bottom sheet or leaf is close to the upper side of the bottom wall on which the stack comes to rest when or immediately after the feeding step is completed.

The feeding step preferably includes supporting the stacks from below all the way during advancement of stacks into the interior of receptacles at the predetermined location. As mentioned above, the stacks may consist of superimposed sheets of paper or the like so that each stack includes a lowermost sheet. The feeding step is preferably carried out in such a way that the stacks are advanced along a horizontal path at a level immediately above the bottom wall of a receptacle at the predetermined location. Thus, the lowermost sheet of a stack which approaches the predetermined location is disposed at a level which is only slightly above the respective bottom wall so that such lowermost sheet can come to rest on the respective bottom wall by descending through a short or negligible distance which is substantially less than the height of a stack (i.e., through a distance which is a minute fraction of that between the upper side of the bottom wall and the open top of the receptacle) prior to coming into contact with the bottom wall of the corresponding receptacle.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
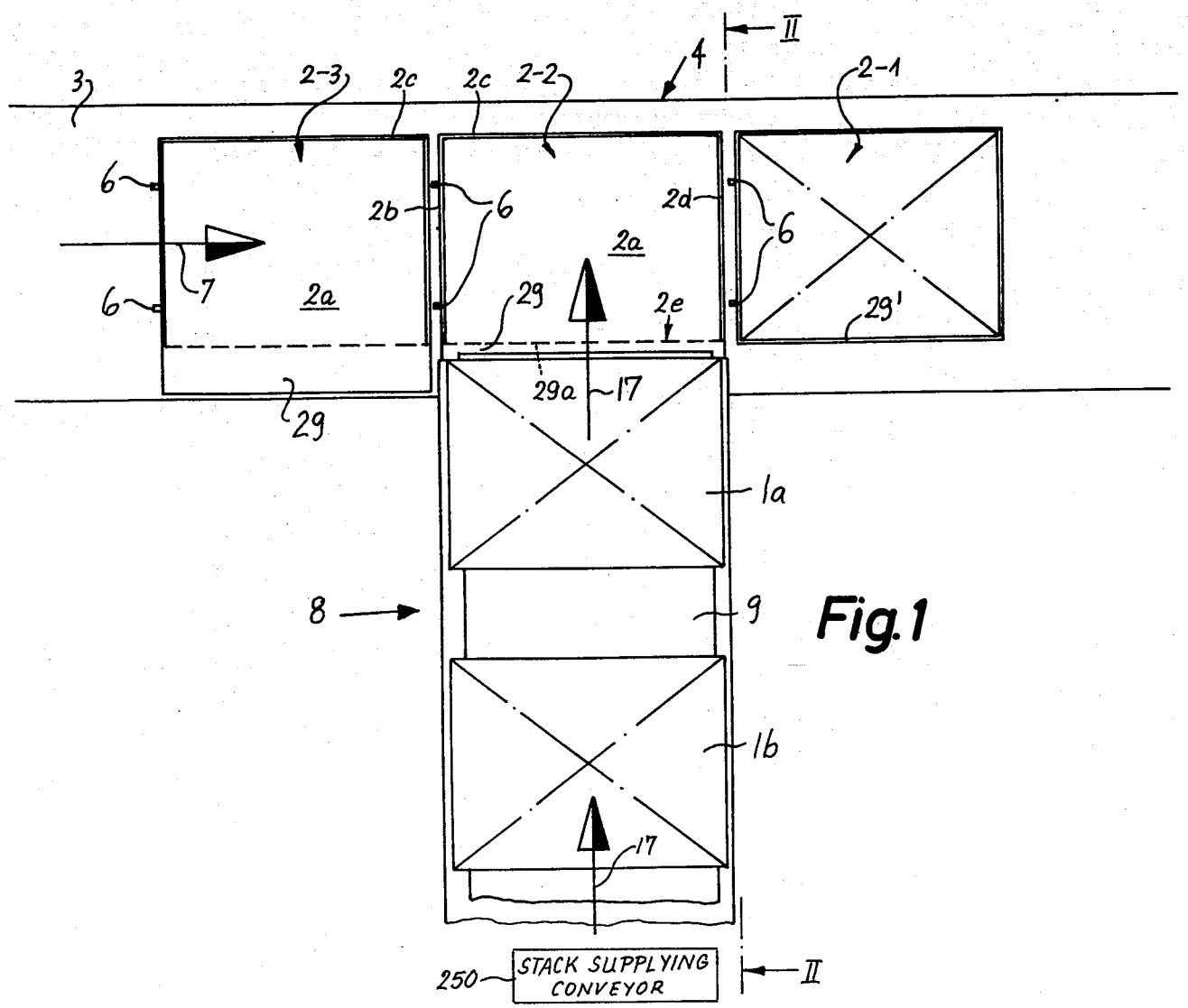
FIG. 1 is a schematic plan view of an apparatus which embodies one form of the invention and wherein the transfer unit which feeds stacks into successive receptacles receives stacks from a single-track stack supplying conveyor.

FIG. 1 illustrates, very schematically, the components of an apparatus which embodies one form of the invention and serves to introduce successive stacks (two stacks 1*a* and 1*b* are shown) into successive discrete receptacles in the form of cardboard boxes or cartons. The illustrated cartons include an empty carton 2-3, a carton 2-2 which is held at a predetermined location (i.e., in a predetermined position) 4 and is about to receive the stack 1*a*, and a filled carton 2-1. The arrow 7 indicates the direction of intermittent advancement of cartons 2-1, 2-2, 2-3 along a horizontal or nearly horizontal path. The system for advancing the cartons comprises a delivering means 3 which is an elongated (preferably endless) conveyor having several transversely aligned rows or sets of entraining elements in the form of pushers 6 and means (not specifically shown) for advancing the pushers 6 in stepwise fashion so that, when the conveyor 3 including the pushers 6 is caused to perform the next step, the carton 2-3 assumes the position previously occupied by the carton 2-2 and the carton 2-2 assumes the position previously occupied by the carton 2-1.

The stacks 1*a*, 1*b* consist of superimposed sheets of paper or other sheet-like material and are supported by the upper reach of an endless belt or band conveyor 9 forming a stack feeding means of a transfer unit 8. The upper stretch or reach 9R (see FIG. 2*b*) of the conveyor 9 defines a substantially horizontal path at the general lever of the path which is defined by the carton delivering means 3 and extends at right angles to the direction indicated by the arrow 7. The direction in which successive stacks 1*a*, 1*b*, etc. are fed into the corresponding cartons 2-2, 2-3, etc, are indicated by arrows 17. The number of and the distances between the pushers 6 in each row are selected in such a way that each row of pushers can maintain the respective carton in a predetermined orientation, namely, an orientation in which an opening 2*e* between two neighboring upstanding side walls 2*b*, 2*d* of the carton (see the carton 2-2) at the location 4 faces the foremost stack on the upper reach 9R of the conveyor 9 forming part of the transfer unit 8.

Figure 1A:
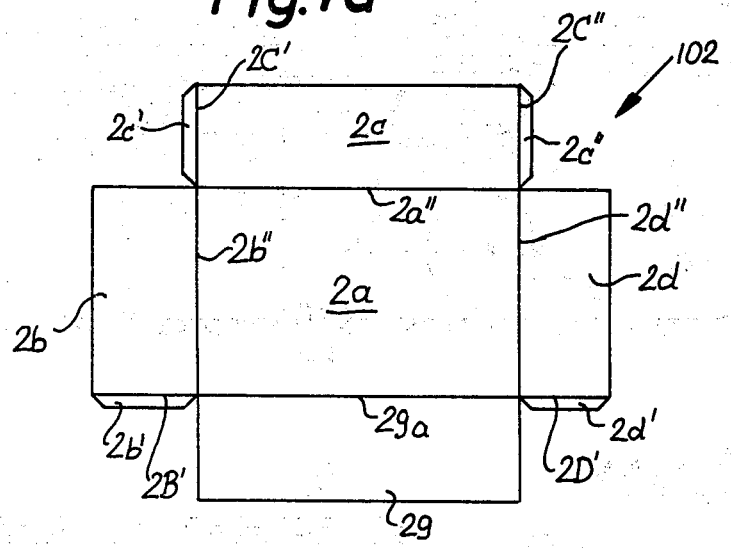
FIG. 1*a* is a plan view of a flat blank which can be converted into a receptacle for use in the apparatus of the present invention.

FIG. 1*a* shows the details of a flat blank 102 which is about to be converted into a carton, e.g., into the carton 2-3. This blank comprises a central portion which, upon conversion of the blank into an open-sided, open-top carton, constitutes the bottom panel or wall 2*a*. The latter is surrounded by four portions 2*b*, 2*c*, 2*d* and 29 which, upon completion of conversion of the blank 102 into a carton, constitute four side walls of the carton. In accordance with a feature of the present invention, the blank 102 is first converted into a carton whose top is open (see FIG. 1 which shows that the bottom walls 2*a* of the cartons 2-3 and 2-2 are visible from above) and wherein three side walls (2*b*, 2*c*, 2*d*) extend upwardly from the bottom wall 2*a* (i.e., to one side of the bottom wall) whereas the side wall 29 is located at the level of (i.e., it is coplanar with) or below (at the other side of) the bottom wall 2*a*. The neighboring side walls 2*b*, 2*c*, 2*d* are connected to each other by flaps 2*c*', 2*c*'' and each of these flaps is connected to the side wall 2*c* by a weakened portion 2C', 2C'' which is creased or perforated to facilitate pivoting of the respective flaps. The flaps 2*b*', 2*d*' serve to connect the respective side walls 2*b*, 2*d* to the side wall 29 after the corresponding carton has advanced beyond the location 4. The reference character 29*a* denotes a weakened portion constituted by a crease or a row of perforations provided in the region between the bottom wall 2*a* and the side wall 29 to allow for convenient pivoting of the side wall 29 to a level below the bottom wall 2*a* or to a position in which the side wall 29 can be connected with the flaps 2*b*', 2*d*'. The reference numerals 2B' and 2D' respectively denote creases or analogous weakened portions between the side walls 2*b*, 2*d* and the corresponding flaps 2*b*', 2*d*'. The weakened portions (e.g., creases) between the bottom wall 2*a* on the one hand and the side walls 2*b*, 2*c*, 2*d* on the other hand are shown at 2*b*'', 2*a*'' and 2*d*''.

It is clear that the flaps which are shown in FIG. 1*a* (and which are coated with a suitable adhesive prior to bonding of the neighboring side walls to each other) constitute but one form of means for connecting such neighboring side walls to each other so as to convert the blank 102 into an open-side, open-top carton. For example, the flaps can be replaced with short strips of adhesive-coated uniting band or tapes, or such flaps can be secured to each other by staples or by stitching. All that counts is to convert each blank 102 into a receptacle which is open at one side so that, when its bottom wall 2*a* is located in a substantially horizontal plane, the side walls 2*b*–2*d* extend upwardly and the side wall 29 is coplanar with or is located at a level below the bottom wall 2*a*. This results in the provision of an opening 2*e* which extends between the side walls 2*b*, 2*d* and all the way down to the crease 29*a*. The opening 2*e* allows a stack to enter the carton when the latter is held at the location 4.

Figure 2A:
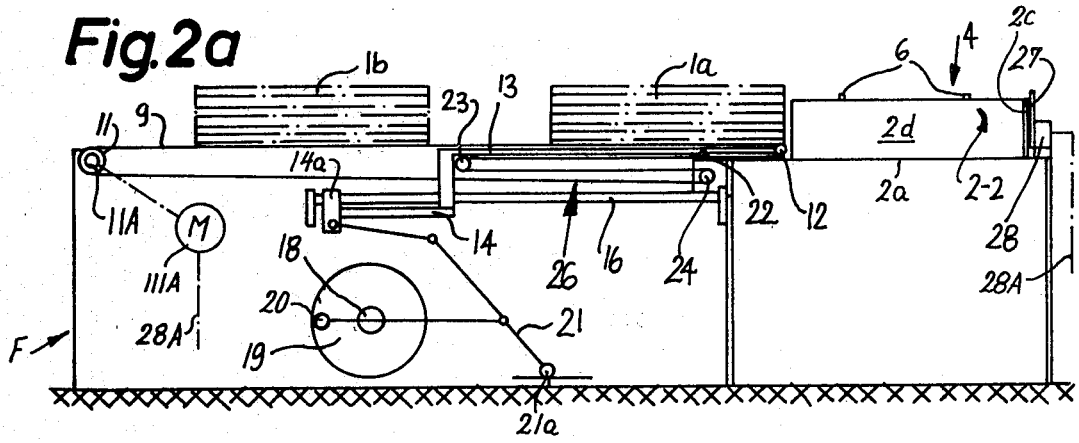
FIG. 2*a* is a transverse vertical sectional view as seen in the direction of arrows from the line II—II of FIG. 1 and shows the component parts of the transfer unit in positions they assume prior to delivery of a stack into the interior of a receptacle at the predetermined location.
Figure 2B:
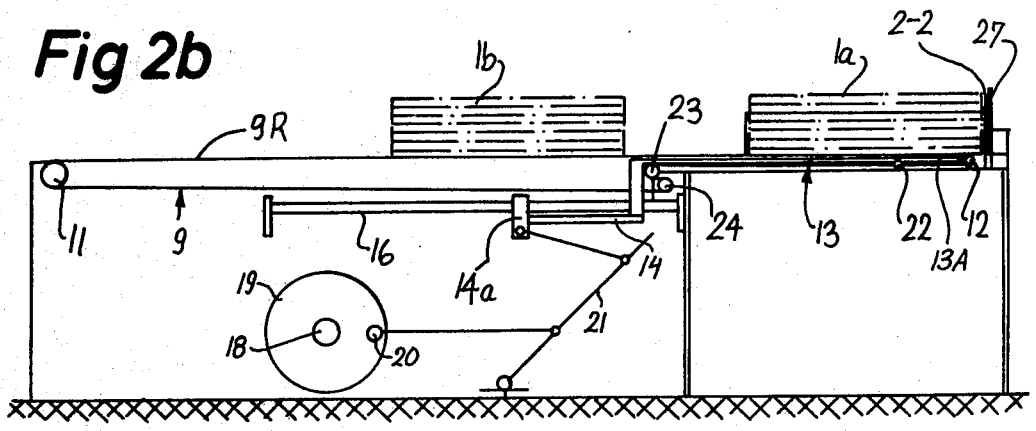
FIG. 2*b* illustrates the structure of FIG. 2*a*, with the component parts of the transfer unit shown in the positions they assume on completion of insertion of a stack into the corresponding receptacle.
Figure 2C:
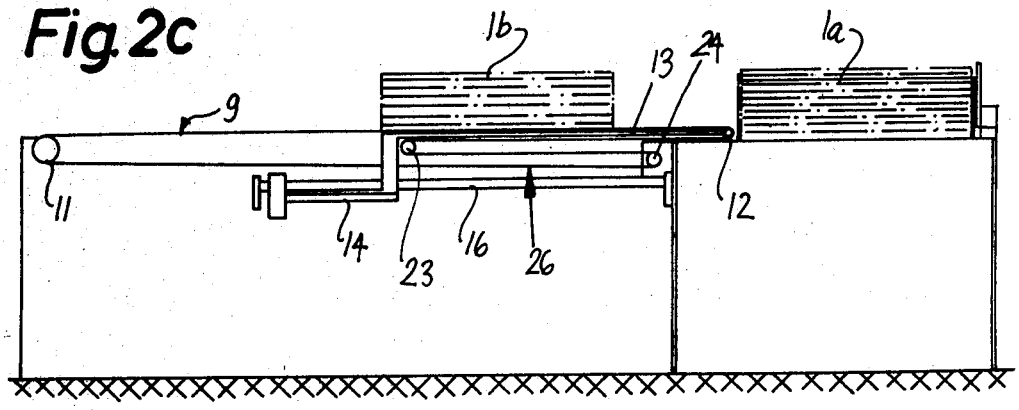
FIG. 2*c* illustrates the structure of FIG. 2*a* or 2*b*, with the component parts of the transfer unit shown in the positions they assume subsequent to retraction from the freshly filled receptacle.

The transfer unit 8 is shown in greater detail in FIGS. 2a, 2b and 2c. It is mounted on a stationary frame F and its stack-feeding conveyor 9 is trained over two spaced-apart rotary members in the form of pulleys 11, 12 so that its upper reach 9R is located in a horizontal or nearly horizontal plane at the level of the bottom wall 2a of the carton 2-2 at the location 4. The pulley 11 is rotatable about the stationary axis of a horizontal shaft 11A which is mounted in the frame F and can be driven by a suitable prime mover 111A e.g., an electric motor installed in, on or adjacent to the frame F. The front pulley 12 (as considered in the direction of arrows 17) is installed at the front end or leader 13A of a flat elongated boom or cantilever arm 13 which constitutes the front portion of the transfer unit 8 and is reciprocable between the first or extended position of FIG. 2b and the retracted or second position of FIG. 2a or 2c. The front portion 13 is mounted on a carriage 14 which is reciprocable in and counter to the direction of arrows 17 to move the front portion 13 and the front pulley 12 (this pulley can be mounted on the carriage 14 or on the front portion 13) between the positions respectively shown in FIG. 2b and FIGS. 2a, 2c. The guide means for the carriage 14 includes elongated horizontal rails 16 or tie rods which flank the path for the stacks on the upper reach 9R of the conveyor 9 and are installed in the frame F. In addition to the carriage 14, the means for shifting the front portion 13 of the transfer unit 8 between the first and second positions includes a horizontal drive shaft 18 which is mounted in the frame F and is driven by a motor, not shown, a wheel 19 which is rotatable by the shaft 18, an eccentric pin 20 on the wheel 19, and a linkage 21 which transmits motion from the pin 20 to one (14a) of several followers forming part of the carriage 14 and slidable along the guide rails 16. The linkage 21 is pivotably installed in the frame F, as at 21a.

The means for supporting the forwarding extending front portion 13 of the transfer unit 8 in the frame F to prevent excessive flexing or bending of the front portion includes one or more idler rollers 22 installed at the leader 13A and resting on a horizontal supporting surface of the frame F below the path along with the stacks are advanced toward the location 4.

The belt conveyor 9 is further trained over two additional rotary members or pulleys 23 and 24 which constitute loop forming or tensioning elements because they cause the conveyor 9 to form a loop 26 whose size increases or decreases, depending on the direction of movement of the carriage 14 for the front portion 13 of the transfer unit 8. The pulleys 23, 24 are rotatable about parallel horizontal axes and are respectively mounted on the carriage 14 and in the frame F. The pulley 23 is located behind the pulley 24 and moves toward the pulley 24 when the carriage 14 is caused to shift the front portion 13 of the transfer unit 8 into the interior of the carton 2-2 at the location 4. This entails a reduction of the size of the loop 26 to its minimum value. The size of the loop 26 increases during movement of the front portion 13 back to the retracted or second position of FIG. 2a or 2c. All movements of the pulley 23 are synchronized with those of the pulley 12 and front portion 13, i.e., the extent of forward or rearward movement of the pulley 23 is the same as that of the front portion 13 and/or pulley 12.

Since the opening 2e of the carton 2-2 at the location 4 is disposed at such level that it allows for introduction of the stack 1a directly into the interior of this carton, the stack need not be caused to enter the carton by gravity. Therefore, the carton at the location 4 can be said to constitute a stack receiving device which can accept stacks directly from the transfer unit 8. Consequently, a depository for stacks at a level above the cartons (such depository is a necessary constituent of conventional apparatus wherein the stacks are caused to enter the cartons through the open tops of the cartons by descending under the action of gravity) can be disposed with.

FIGS. 2a–2c show that a carton (2-2) which is properly oriented at the location 4 abuts (with the side wall 2c thereof) against a fixed stop 27 which is mounted on the frame F and is adjacent to a sensing element 28 serving to generate an arresting signal for the prime mover 111A when the front portion 13 of the transfer unit 8 reaches the position of FIG. 2b and a stack (1a) urges the side wall 2c of the corresponding carton (2-2) against the stop 27 with a requisite force. The sensing element 28 may constitute a mechanical sensor which is displaced by the carton 2-2 at the location 4 when the carton receives a properly introduced stack and then transmits an arresting signal to the prime mover 111A by way of an operative connection 28A which is indicated by a phantom line.

The operation of the apparatus which is shown in FIGS. 1 and 2a to 2c is as follows:

The delivering means 3 supplies cartons 2-1, 2-2, 2-3, etc. along the horizontal path which includes the location 4. The pushers 6 are driven intermittently (in the direction indicated by the arrow 7) so that one of the cartons is always disposed at the location 4 when the drive means for the pushers is arrested. The carton (2-2) at the location 4 is then oriented in such a way that its open side 2e faces toward the foremost stack (1a) on the upper reach 9R of the endless belt conveyor 9. This is due to the fact that the fourth side wall 29 of the carton 2-2 at the location 4 is disposed at the level of or below the respective bottom wall 2a, i.e., the opening 2e extends all the way to the weakened portion or crease 29a and ensures that the path for the delivery of stacks 1a, 1b, etc. extends all the way to the location 4. The manner in which the side wall 29 of the carton which approaches and/or is disposed at the location 4 can be maintained in the plane of or at a level below the bottom wall 2a will be described in detail with reference to the apparatus which is shown in FIGS. 3, 4a, 4b, 5 and 6. It suffices to say that the apparatus of FIGS. 1 and 2a–2c preferably also comprise means for holding the side walls 29 of successive cartons at the level of or below the respective bottom walls 2a, at least until the filling of such cartons at the location 4 is completed. As explained above, the carton (2-2) at the location 4 constitutes a stack receiving device, i.e., there is no need to remove the stack from such stack receiving device for delivery into a carton or another receptacle. This saves a step which is indispensable if the cartons are filled in the conventional way, namely, by moving the stacks to a position above the open tops of empty cartons and by causing or allowing the stacks to descend by gravity into the cartons therebelow.

The prime mover 111A drives the shaft 11A for the rear pulley 11 so that the endless belt conveyor 9 is in motion and its upper reach 9R travels in the direction which is indicated by the arrow 17. Therefore, the foremost stack 1*a* is advanced toward and to a position of alignment with and above the front portion 13 of the transfer unit 8. Such front portion is then located in the retracted or second position which is shown in FIG. 2*a*. When the stack 1*a* reaches the position of FIG. 2*a*, the shaft 18 beings to rotate the wheel 19 in a clockwise direction, as viewed in FIG. 2*a*, so that the linkage 21 causes the carriage 14 to travel along the guide rails 16 and to shift the front portion 13 of the transfer unit 8 to the first or extended position of FIG. 2*b*. Such shifting of the front portion 13 takes place simultaneously with forward movement of the pulleys 12 and 23, i.e., the length of the upper reach 9R of the belt conveyor 9 increases and the size of the loop 26 decreases. Consequently, the front portion 13 enters the interior of the carton 2-2 at the location 4 and the foremost stack 1*a* is then located at a level above and close to the bottom wall 2*a* of the carton 2-2. The front pulley 12 is also located in the interior of the carton 2-2 because this pulley is mounted in the region or directly on the leader 13A of the front portion 13. The pulley 23 is immediately or closely adjacent to the pulley 24 so that the size of the loop 26 is reduced to the minimum value, the reduction of the size of the loop 26 having been responsible for the ability of the front pulley 12 to increase the length of the upper reach 9R of the belt conveyor 9. The inclination of the upper side of the front portion 13 (and hence the inclination of sheets which form the stack 1*a*) remains unchanged because the idler roller or rollers 22 at the leader 13A of front portion 13 rest on and roll along the aforementioned supporting surface of the frame F. The prime mover 111A is on while the linkage 21 shifts the carriage 14 in a direction to the right, as viewed in FIG. 2*a*, i.e., while the front portion 13 of the transfer unit 8 advances from the second or retracted position to the extended or first position of FIG. 2*b*. This means that the front edge of the stack 1*a* remains at or in the region of the leader 13A and can engage the inner side of the side wall 2*c* to push this side wall against the stop 27 when the front portion 13 reaches its foremost (second or extended) position. The side wall 2*c* then actuates the sensing element 28 which transmits a signal via operative connection 28A to arrest the prime mover 111A for the belt conveyor 9. The shaft 18 continues to rotate the wheel 19 in a clockwise direction, as viewed in FIG. 2*b*, whereby the linkage 21 beings to shift the carriage 14 in a direction to the left, i.e., the front portion 13 leaves the first position of FIG. 2*b* and travels back toward the retracted or second position, namely, to the position which is shown in FIG. 2*c*. The pulley 12 shares such rearward movement of the front portion 13 and is retracted from the interior of the carton 2-2. This results in gradual deposition of the lowermost sheet of the stack 1*a* onto the upper side of the bottom wall 2*a* at the location 4. The conveyor 9, which is not driven by the prime mover 111A while the front portion 13 travels from the position of FIG. 2*b* to the position of FIG. 2*c*, is peeled off the underside of the lowermost sheet of the stack 1*a* because the size of the loop 26 increases at the same rate at which the length of the upper reach 9R of the conveyor 9 decreases. In other words, the stack supporting upper surface of the upper reach 9R does not slide relative to the underside of the lowermost sheet of the stack 1*a* so that such lowermost sheet is neither damaged nor defaced nor shifted in response to extraction of the front portion 13 from the interior of the carton 2-2. This means that separation of the upper reach 9R from the lowermost sheet of the stack 1*a* in the carton 2-2 takes place without the generation of any frictional forces between the stack and the conveyor 9 which is highly desirable in each and every instance but especially if the sheets of the stacks are relatively thin and readily deformable and/or when the surfaces of the sheets are very smooth so that one or more sheets at the bottom of a stack in its carton would be likely to slide relative to the sheets thereabove if the retraction of the front portion 13 were accompanied by frictional engagement between the belt conveyor 9 and the adjacent lowermost sheet of the freshly inserted stack. Gentle treatment of sheets which are assembled into stacks is equally desirable when the sheets consist of pressure-sensitive material, such as carbon-free copy paper.

Furthermore, the just described mode of removing the front portion 13 of the transfer unit 8 from the interior of a carton at the location 4 ensures that the orientation and/or position of the inserted stack (as considered in the direction of arrows 17) does not change at all, i.e., the stacks of a long series of successive stacks can be inserted into the respective cartons with a surprisingly high degree of reproducibility. Moreover, there is no need to orient each empty carton with an utmost degree of precision because the oncoming stacks can change the orientation of the cartons at the location 4 by pressing the rear side walls 2*c* of such cartons against the stop 27. Thus, when the filling step is completed, each freshly filled carton assumes a predetermined optimum position with reference to the delivering means 4 and the stack in each freshly filled carton assumes an optimum position with reference to the bottom and side walls of such carton.

When the front portion 13 of the transfer unit 8 reassumes the retracted or second position (see FIG. 2*c*), the front pulley 12 is also fully retracted from the interior of the carton 2-2 so that the delivering means 3 including the pushers 6 can be set in motion to advance the carton 2-2 to the position previously occupied by the carton 2-1 and to simultaneously deliver the empty carton 2-2 to the location 4. It is preferred to provide the apparatus with suitable means (e.g., one or more cams, not shown in FIG. 1 or FIGS. 2*a*–2*c*) for pivoting the front side wall 29 of the freshly filled carton 2-2 to the closed position in automatic response to advancement of the carton 2-2 from the location 4 to the position which was previously occupied by the carton 2-3. The reference character 29' denotes in FIG. 1 the front side wall 29 of the filled carton 2-1 in closed position, i.e., the wall 29 in the position 29' has closed the opening 2*e* of the respective carton so that the latter is ready to be provided with a suitable cover or lid, not shown.

The just described mode of transporting cartons along the path which is defined by the delivering means 3 and of admitting stacks along the path which is defined by the transfer unit 8 exhibits the additional advantage that the edges of stacks 1*a*, 1*b*, etc. are not only highly unlikely to be but practically incapable of being deformed during transport toward and/or during introduction into the respective cartons. Moreover, pivoting of the front side walls 29 to their closed or closing positions 29' also does not or need not entail any deformation of the freshly inserted stacks, i.e., the edges of the stacks in the respective cartons are not affected by the fact that the front side walls 29 are pivoted to their closed positions upon completion of the filling step. The weakened portions 29*a* of the cartons facilitate predictable pivoting of the front side walls 29 to the positions 29′ with a minimum of effort and in such a way that, when pivoted to the position 29′, each side wall 29 is held in an optimum position for proper closing of the respective opening 2e.

The manner in which the freshly filled cartons are provided with covers or lids forms no part of the present invention. The application of covers can take place while the freshly filled cartons occupy positions corresponding to that of the carton 2-1 shown in FIG. 1.

The prime mover 111A for the belt conveyor 9 is started again when the carriage 14 returns the front portion 13 of the transfer unit 8 to the retracted position of FIG. 2c. The upper reach 9R then advances the stack 1b to the position of alignment with the front portion 13 and a fresh stack is deposited on the conveyor 9 behind the stack 1b. The procedure is then repeated, i.e., the stack 1b is introduced into the carton 2-3 at the location 4 and the front portion 13 is retracted from such carton in such a way that the upper reach 9R does not slide relative to the underside of the stack 1b in the carton 2-3.

The conveyor 9 can be mounted, in its entirety, on the carriage 14 so as to share all movements of the front portion 13 toward or away from the location 4. This would necessitate some modifications of the controls and would render it possible to omit the pulleys 23 and 24. The conveyor 9 of FIGS. 2a–2c is preferred at this time because the long upper reach 9R provides ample room for deposition of stacks on the conveyor regardless of the position of the front portion 13.

The reference character 250 denotes in FIG. 1 a single-track stack supplying conveyor which ensures that the upper reach 9R of the conveyor 9 receives a fresh stack during each interval between two successive forward movements of the carriage 14.

The apparatus which is shown in FIGS. 3, 4a, 4b, 5 and 6 also serves for introduction of stacks of overlapping paper sheets or the like into successive receptacles (e.g., cartons) of a series of receptacles. The means for delivering successive prefabricated cartons 32 to the predetermined location (carton filling station) 34 includes a conveying device 31 which advances successive cartons stepwise in the direction indicated by the arrows 33. The path which is defined by the conveying device 31 is preferably (but not necessarily) horizontal and extends toward, through and beyond the location 34, i.e., the conveying device 31 serves to deliver empty cartons 32 to the location 34, to temporarily hold successive cartons (32′) at the location 34, and to advance freshly filled cartons beyond the location 34. The front side walls of the cartons 32 in the path which is defined by the conveying device 31 are shown at 37. The apparatus comprises means 35 for pivoting or otherwise moving such front side walls into or below the planes of the bottom walls 32a of the respective cartons 32. The means 35 can constitute a guide or cam along which the front side walls 37 slide during transport toward the location 34 and which is contacted by the side walls 37 during dwell of successive cartons at the location 34. The openings which are defined as a result of pivoting of side walls 37 into the planes of or below the respective bottom walls 32a are indicated at 32e. Such openings allow for introduction of stacks 39, 39a, 39b, 39c, etc. into successive cartons at the location 34 in substantially the same way as described in connection with FIGS. 1 and 2a–2c, i.e., without the need for dropping the stacks from above through the open tops and into the interior or successive cartons.

The transfer unit which delivers successive stacks to the location 34, i.e., into successive foremost empty cartons (and more particularly onto the bottom walls 32a of such cartons) is shown at 38. The path which is defined by the transfer unit 38 for delivery of successive stacks is located at the level of the path defined by the conveying device 31, at least in the region of the location 34, to allow for convenient introduction of stacks into the respective cartons.

Figure 4A:
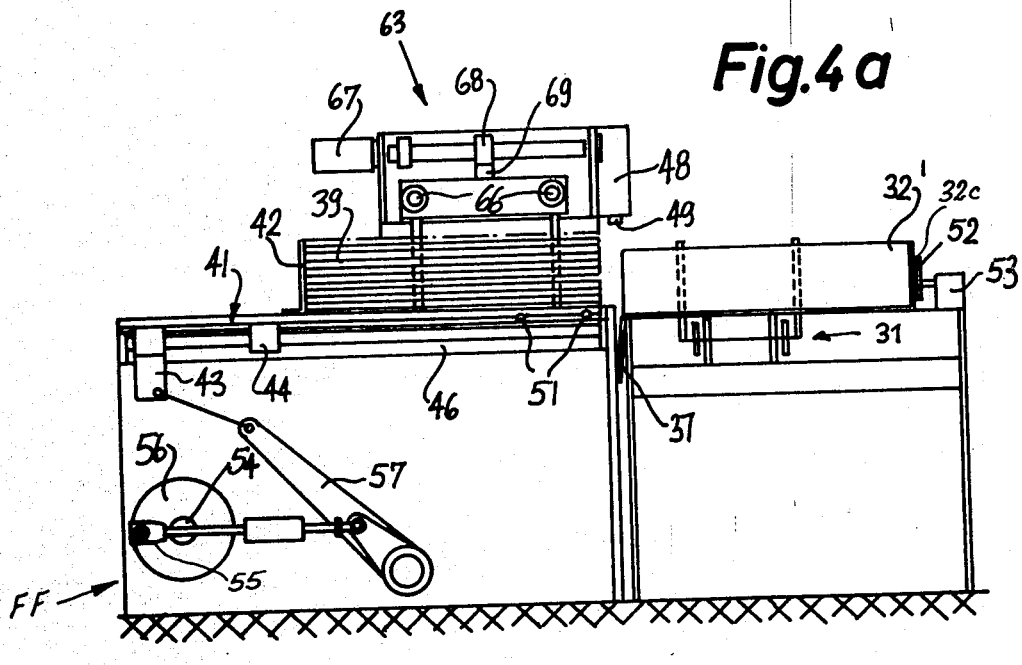
FIG. 4*a* is an enlarged transverse vertical sectional view as seen in the direction of arrows from the line IV—IV of FIG. 3.
Figure 4B:
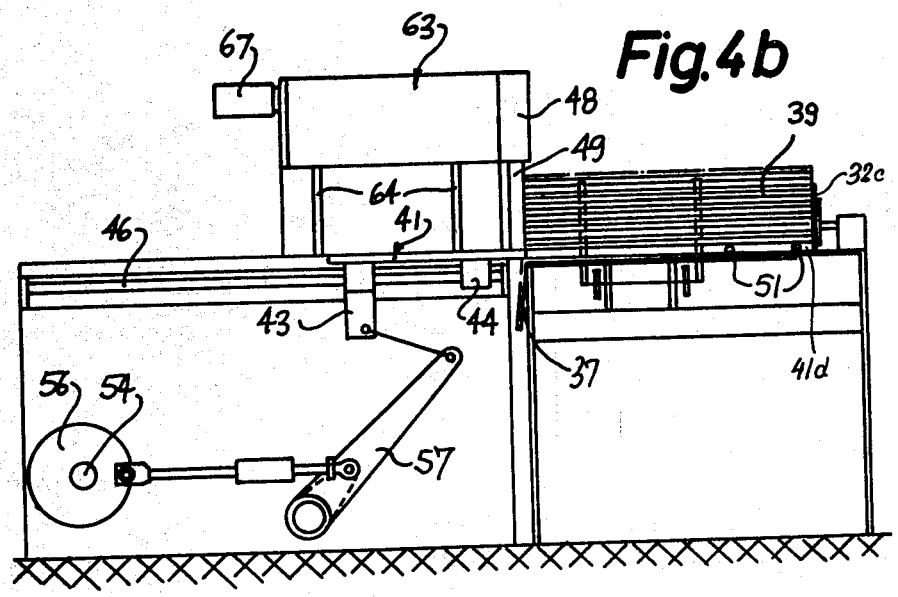
FIG. 4*b* illustrates the structure of FIG. 4*a*, with the transfer unit of the modified apparatus in the position it assumes on completion of insertion of a stack into the associated receptacle.

The details of the transfer unit 38 are shown in FIGS. 4a and 4b. The transfer unit 38 comprises a stack-feeding platform 41 which is or can be said to be a functional equivalent of the upper reach of the belt conveyor 9 in the transfer unit 8 and cooperates with a pusher 42 which can engage the rear side of a stack (see the stack 39 in FIG. 4a) on the upper side of the platform 41. The means for delivering successive stacks 39, 39a, 39b, 39c, etc. onto the platform 41 in front of the pusher 42 includes an intermediate conveyor 63 which is shown in detail in FIG. 5. The platform 41 has downwardly extending marginal followers 43 and 44 which are slidable along stationary guide rails or tie rods 46 extending in parallelism with the direction of reciprocatory movement of the platform 41 toward or away from the location 34. The direction in which the platform 41 is moved during shifting toward and into the carton 32′ at the location 34 is indicated by the arrow 47. If desired, the platform 41 can be provided with followers at one of its longitudinal marginal portions or between the two longitudinal marginal portions. The guide means for the platform 41 then comprises a single rail or tie rod 46.

FIG. 4a shows the platform 41 in the retracted position corresponding to the second position of the front portion 13 of the transfer unit 8. In FIG. 4b, the platform 41 is held in the first or extended position, namely, in the interior of the carton 32′ at the location 34. The apparatus of FIGS. 3, 4a, 4b, 5 and 6 further comprises a stripping or separating device including a motor 48 (e.g., a double-acting pneumatic cylinder and piston unit of any known design) whose piston rod 49 is movable between the raised or inoperative position of FIG. 4a and the extended or operative position of FIG. 4b. When in the operative position, the piston rod 49 constitutes a stripping element which is disposed behind the stack 39 in the interior of the carton 32′ and prevents retraction of such stack during withdrawal of the platform 41. The underside of the platform 41 carries one or more friction reducing rollers 51 or analogous rotary elements which can roll along a supporting surface of the frame FF or along the bottom wall 32a of the carton 32′ at the location 34. This ensures that the platform 41 cannot be tilted or otherwise misoriented under the weight of the stack 39 thereon. The rollers 51 are preferably installed on or in the region of the foremost portion or leader 41d of the platform 41.

The frame FF supports a stop 52 which serves as an abutment for the rear side wall 32c of the carton 32′ at the location 34 and is disposed in front of a sensing element 53. The latter monitors the position of the carton 32′ at the location 34 and the position of the stack 39 in such carton.

The means for shifting the platform 41 between the extended and retracted positions of FIGS. 4b and 4a comprises a drive shaft 54 which is journalled in the frame FF and is rotated by a motor, not shown. The shaft 54 is connected with a wheel 56 which carries an eccentric pin 55 for one terminal of a linkage 57 which serves as a means for transmitting motion from the pin 55 to the rear follower 43 of the platform 41.

The means for supplying stacks to the platform 41 of the transfer unit 38 comprises a two-track conveying device 100 which can deliver stacks along two tracks 58 and 59. These tracks flank the path of the platform 41 and the stacks which are introduced into such tracks can be advanced by entraining elements similar or analogous to the pushers 6 of the delivering means 3 shown in FIG. 1. The foremost stack (see the stack 39*a* of FIG. 3) in the track 58 can be delivered onto the platform 41 (while the platform is in the retracted position of FIG. 4*a*) in the direction of the arrow 61. The arrow 62 indicates the direction of delivery of successive stacks (39*b*, etc.) from the track 59 onto the platform 41 in front of the pusher 42. The arrangement is such that the platform 41 alternately receives stacks, 39*a*, 39*b*, 39*c*, etc. from the tracks 59 and 58. The directions in which the stacks are respectively advanced by the entraining elements of the conveying device 100 in the tracks 58 and 59 are indicated by the arrows 58A and 59A.

Figure 5:
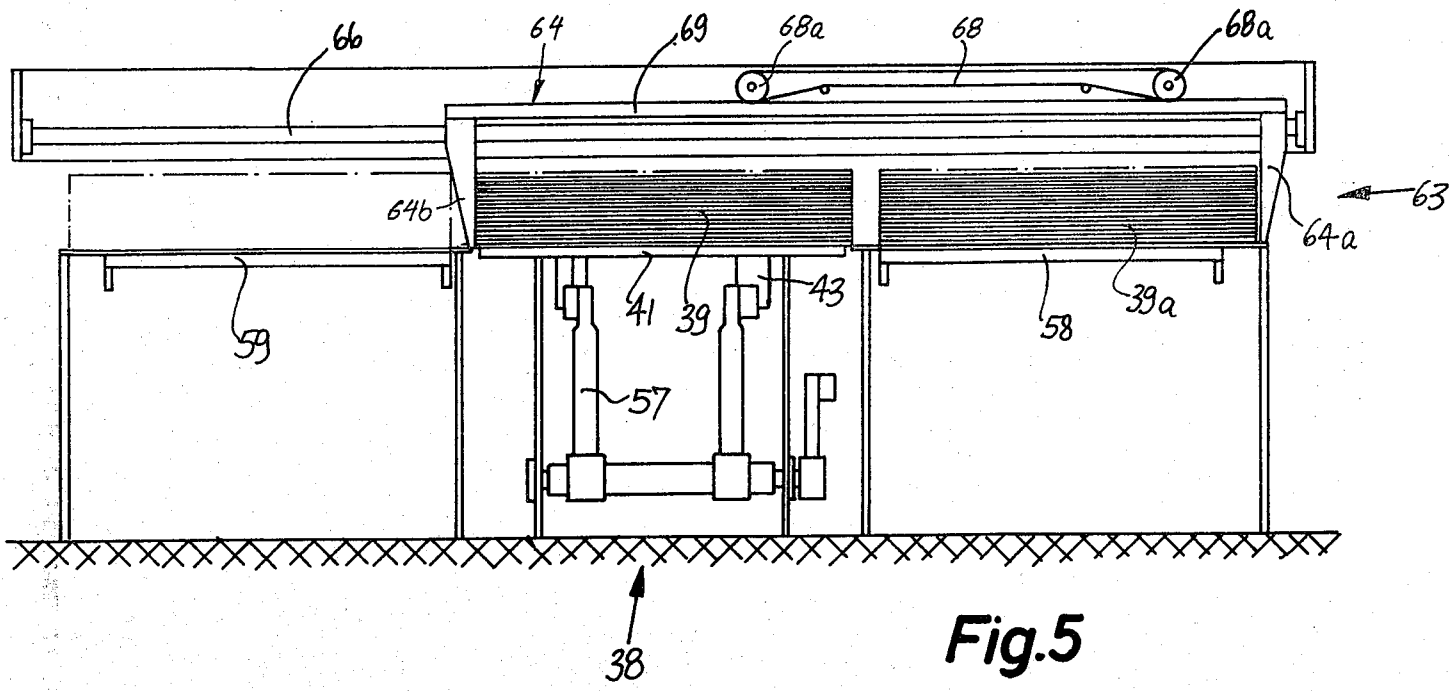
FIG. 5 is a sectional view as seen in the direction of arrows from the line V—V of FIG. 3.

The means for effecting the delivery of stacks from the tracks 58, 59 onto the platform 41 includes the aforementioned intermediate conveyor 63, the details of which are shown in FIG. 5. This intermediate conveyor comprises an inverted U-shaped bridge or yoke 64 which is reciprocable at right angles to the direction of movement of the platform 41 along the guide rail or guide rails 46 and is disposed at a level above the path which is defined by the transfer unit 38. In other words, the yoke 64 is movable in the direction of the arrow 61 or 62. The length of the yoke 64 is such that it simultaneously overlies the transfer unit 38 and one of the tracks 58, 59 in one of its end positions and that it simultaneously overlies the transfer unit 38 and the other of these tracks in the other of its end positions. The yoke 64 is guided by several tie rods 66 whose axes are normal to the direction of reciprocatory movement of the platform 41. The means for reciprocating the yoke 64 comprises a reversible prime mover 67 (e.g., an electric motor shown in FIGS. 4*a* and 4*b*) which drives the yoke by way of an endless chain 68 trained over sprocket wheels 68*a* and toothed rack 69 which is in engagement with the chain 68. The direction of rotation of the output element of the motor 67 is reversed in synchronism with operation of the conveying device 100 so that the downwardly extending leg 64*a* of the yoke 64 pushes a stack from the track 58 onto the platform 41 in front of the pusher 42 when the sprocket wheels 68*a* are rotated in a first direction, and that the downwardly extending leg 64*b* of the yoke 64 pushes a stack from the track 59 onto the platform 41 in front of the pusher 42 when the sprocket wheels 68*a* are caused to rotate in the opposite direction. The legs 64*a* and 64*b* are disposed at the ends of the horizontal toothed rack 69 which constitutes a crosshead or traverse of the yoke 64.

The conveying device 100 need not have several tracks all the way between the actual source of stacks and the platform 41. Thus, this conveying device may comprise a single track which branches into the tracks 58, 59 so that these tracks or branches flank the transfer unit 38.

Figure 3:
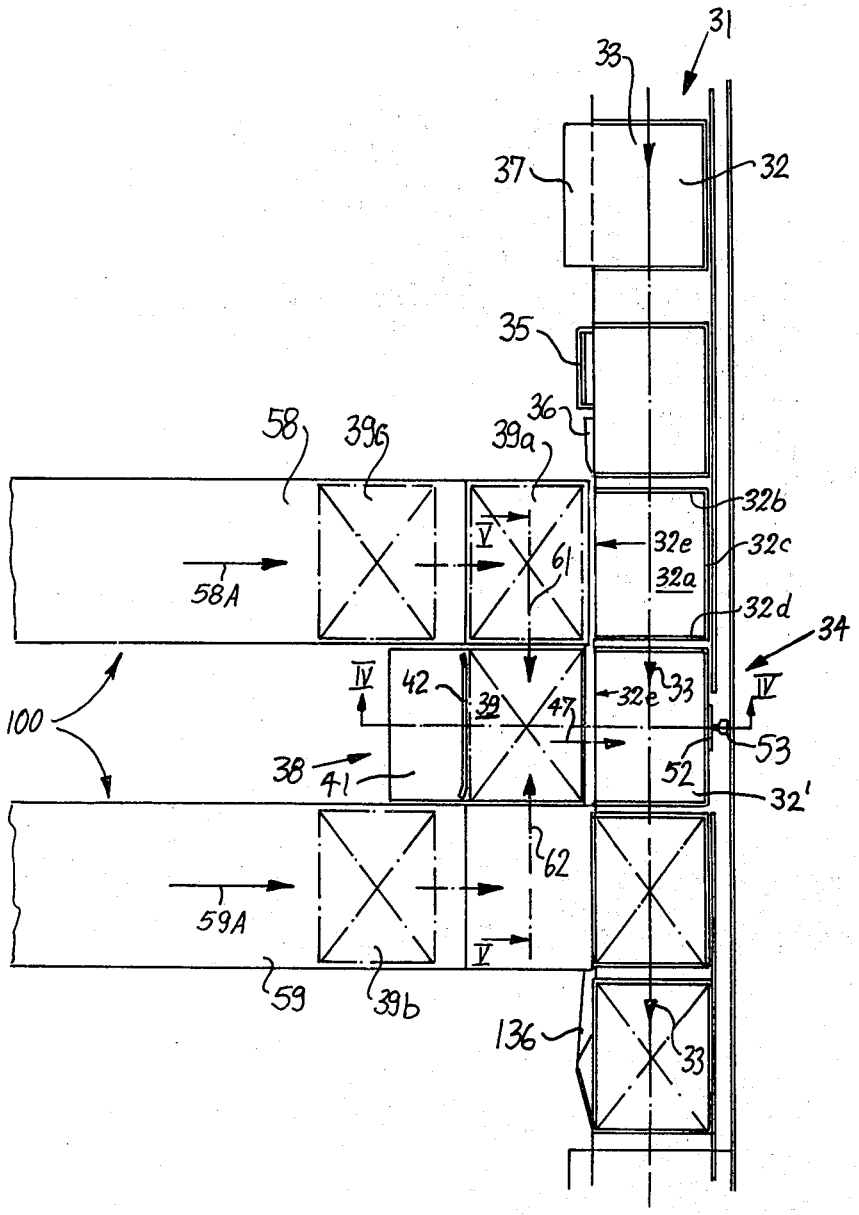
FIG. 3 is a schematic plan view of a modified apparatus wherein the transfer unit can receive stacks from a two-track stack supplying conveyor.

The operation of the apparatus which is shown in FIGS. 3, 4*a*, 4*b*, 5 and 6 is as follows:

The conveying device 31 delivers cartons 32 (i.e., converted flat blanks of the type shown in FIG. 1*a*, with one of their sides open) in stepwise fashion so that the cartons advance in the direction indicated by the arrows 33. As explained above, the fourth or front side of each carton 32 is open during transport toward and during dwell at the location 34. In the embodiment of FIGS. 3–5, the path which is defined by the conveying device 31 extends along the aforementioned moving or pivoting means 35 which engages the forwardly extending side wall 37 of an oncoming carton 32 (namely, a side wall 37 which is located in the plane of the respective bottom wall 32*a*) and preferably pivots such side wall to a level below the bottom wall 32*a*, i.e., into a plane which is normal or nearly normal to the plane of FIG. 3 (see FIGS. 4*a* and 4*b*). The thus pivoted side wall 37 is engaged by a guide means 36 which maintains or holds the freshly pivoted side wall 37 in a plane extending substantially at right angles to the plane of FIG. 3. The openings 32*e* of a carton which approaches the location 34 and of the carton 32' of the location 34 face toward the transfer unit 38.

The carton 32' at the location 34 is to receive the stack 39 on the platform 41 which forms part of the transfer unit 38. This stack has been delivered onto the platform 41 by the yoke 64 of the intermediate conveyor 63 from the track 59 of the conveying device 100. When the carton 32' has arrived at the location 34 and the stack 39 is supported by the platform 41, the shaft 54 is rotated to turn the wheel 56 clockwise, as viewed in FIG. 4*a* or 4*b*, whereby the platform 41 moves from the retracted position of FIG. 4*a* to the extended position of FIG. 4*b* and delivers the stack 39 into the carton 32'. At the same time, the inserted stack 39 causes the rear side wall 32*c* of the carton 32' to bear against the stop 52 so that the carton 32' is properly oriented with respect to the entraining elements of the conveying device 31 and the stack 39 is properly oriented with respect to the location 34. The platform 41 enters the carton 32' by moving through the opening 32*e* above the side wall 37 which is held in the position of FIG. 4*a* or 4*b* by the guide means 36.

Figure 6:
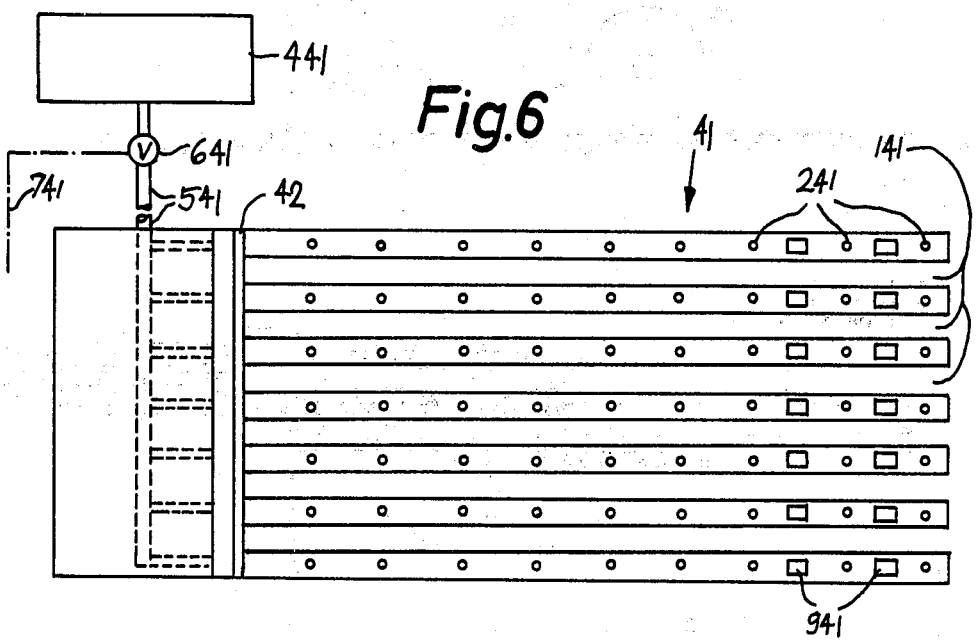
FIG. 6 is a plan view of a platform in the transfer unit of the apparatus shown in FIGS. 3 to 5.

The sensing element 53 monitors the position of the carton 32' at the location 34 and transmits a signal when the rear side wall 32*c* of such carton is urged against the stop 52 whereby the signal from the sensing element 53 initiates actuation of the cylinder and piston unit 48 which causes the piston rod 49 to move downwardly behind the stack 39 in the carton 32' before the platform 41 begins to move back to the retracted portion of FIG. 4*a*. Such movement is effected by the linkage 57 in response to renewed or continuing rotation of the drive shaft 54. The tip or lower end portion of the piston rod 49 is preferably designed in such a way that it reliably engages the adjacent edge face of the lowermost sheet in the stack 39 which is disposed in the interior of the carton 32', i.e., retraction of the platform 41 from the carton 32' should not result in retraction of one or more sheets at the lower end of such stack. As shown in FIG. 6, the platform 41 can be provided with one or more recesses in the form of elongated slots 141 which extend in parallelism with the direction indicated by the arrow 47 to reduce the area of its stack-supporting upper side, i.e., to reduce the extent of frictional engagement between the upper side of the platform and the lowermost sheet of the stack 39 in the carton 32' during retraction of the platform from the location 34. The slots 141 may but need not extend all the way to the underside of the platform 41.

It is further possible to provide the upper side or surface of the platform 41 with orifices 241 (see FIG. 6)

for discharge of streamlets of compressed air or another gaseous fluid preparatory to and during retraction of the platform 41 to further reduce the extent of frictional engagement between the platform and the lowermost sheet of the stack 39 during shifting of the platform from the position of FIG. 4*b* to that shown in FIG. 4*a*. The orifices 241 communicate with one or more channels 341 in the interior of the platform 41, and such channel or channels are connected with a source 441 of compressed gas by a conduit 541 containing a shutoff valve 641 which is opened (see the operative connection 741) in automatic response to arrival of the platform 41 at the location 34. The valve 641 can be opened by a trip (not shown) which is installed in the frame FF at the location 34 or by a proximity detector switch which is installed at the location 34 and is indirectly actuated by the platform 41 when the latter reaches the extended position of FIG. 4*b*. The gaseous fluid issuing from the orifices 241 forms a cushion between the upper side of the platform 41 and the underside of the stack 39.

In addition to or as a substitute for the slots 141 and/or orifices 241, the platform 41 can be provided with recessed rollers, spheres or analogous friction reducing rolling elements (two rows of such elements are shown in FIG. 6, as at 941) which contact the underside of the lowermost sheet of the stack on the platform 41 and contribute to a reduction of friction between the platform and the stack during retraction of the platform from the location 34.

The conveying device 31 is set in motion upon retraction of the platform 41 to the position of FIG. 4*a* so that the carton 32' is advanced to the next station (where such carton receives a cover or lid or is treated in another way) and the next-following empty carton 32 reaches the location 34 to assume the position previously occupied by the carton 32'. The reference character 136 denotes in FIG. 3 a pivoting or closing device for the front side walls 37 of successive filled cartons. This device pivots the side walls 37 through approximately 180 degrees so that the upwardly pivoted side walls 37 close the respective openings 32*e* and cooperate with the other side walls 32*b*–32*d* to completely confine all four sides of the stack in a filled carton.

Since the stacks 39, 39*a*, 39*b*, 39*c*, etc. are introduced through openings between side walls rather than through the open tops of successive cartons, the carton filling operation proceeds at a much higher rate than in heretofore known apparatus wherein the stacks must be delivered to a discrete stack receiving device above an empty carton and the bottom wall or support of such receiving device is then moved out of the way to allow for gravitational descent of a stack into the carton therebelow. The provision of a conveying device 100 with several tracks for delivery of stacks to the platform 41 of the transfer unit 38 is desirable for the just outlined reason, i.e., to take full advantage of the ability of the improved apparatus to fill cartons at a frequency greatly exceeding that at which a conventional apparatus is capable of filling cartons from above. The entraining elements which move stacks along the tracks 58 and 59 of the conveying device 100 toward the positions for delivery onto the platform 41 (see the arrows 61 and 62 in FIG. 3) can be readily operated at a speed which suffices to ensure that a stack is always ready for transfer onto the platform 41 as soon as the latter reaches the retracted position of FIG. 4*a*. The legs 64*a* and 64*b* of the yoke 64 of the intermediate conveyor 63 alternately deliver stacks from the tracks 58 and 59, and such delivery takes up very little time because the forward ends of the tracks 58, 59 are preferably immediately adjacent to the respective sides of the platform 41 when the latter assumes the retracted position shown in FIG. 4*a*. The arrangement may be such that the motor 67 for the yoke 64 is started to move the yoke in one direction when the platform 41 reaches its retracted position, that the motor 67 is started to move the yoke 64 in the opposite direction when the platform 41 again returns to the retracted position, that the motor 67 is started to move the yoke in a direction for transfer of a stack from the track 58 when the platform 41 again returns to the retracted position, and so forth. However, it is equally possible to construct and assemble the controls for the motor 67 in such a way that the latter starts the yoke 64 in one direction when a stack is located at the foremost end of the track 58, and that the motor 67 starts the yoke in the opposite direction when a stack is located at the foremost end of the track 59. A stack advances to the foremost portion of the track 58 after the yoke 64 assumes the end position of FIG. 5 because this ensures that the leg 64*a* cannot interfere with such forward movement of the stack in the track 58. Analogously, a stack can advance all the way to the foremost end of the track 59 after the yoke 64 assumes the other end position (namely, the left-hand end position, as viewed in FIG. 5) because this prevents the other leg 64*b* from interfering with such forward movement of the stack on the track 59. It will be noted that movements of the yoke 64 from the one to the other end position automatically entail such positioning of the yoke that its leg 64*a* or 64*b* can entrain a stack from the track 58 or 59 when the motor 67 is started again. This ensures that the relatively simple and compact intermediate conveyor 63 can supply the platform 41 with stacks at the rate which is needed in view of the high output of the improved apparatus.

The transfer unit 38 can be used in the apparatus of FIGS. 1 and 2*a*–2*c* as a substitute for the transfer unit 8 or vice versa.

An important advantage of the improved apparatus is that they can fill cartons or analogous receptacles at a rate greatly exceeding the rate of filling cartons in a conventional apparatus wherein the cartons or like receptacles are filled from above. Another advantage of the improved apparatus is that they can treat the stacks and the sheets of such stacks gently so that the sheets are not defaced, creased, torn and/or otherwise damaged or deformed during introduction into receptacles and during separation of their lowermost sheets from the transfer units. Still further, the improved apparatus are capable of accurately depositing the stacks in the respective receptacles and an automatically correcting the orientation of receptacles during filling with stacks of paper sheets or the like. Furthermore, the apparatus of the present invention are not likely to shift certain sheets or certain layers of sheets relative to the other sheets or layers during delivery of stacks onto the transfer unit and/or during delivery of stacks into the corresponding receptacles and/or during retraction of the transfer unit 8 or 38 from the receptacle at the location 4 or 34. Moreover, the apparatus of the present invention are simpler and more compact than heretofore known apparatus because the discrete stack receiving means above the cartons or like receptacles to be filled can be dispensed with. The exact shape of cartons at the time of introduction of stacks into their interior is not as important as in conventional apparatus because the stacks are not dropped into the cartons and, therefore, eventual bulging of side walls of the cartons and inward movement of their edges is not as disturbing as heretofore.

An additional advantage of the improved apparatus is that it is now possible to omit the step (allowing or causing successive stacks to descend by gravity into the corresponding cartons at the carton filling station) which is most likely to cause prolonged interruptions of normal operation because, as a rule, the most common cause of malfunctioning of heretofore known apparatus is the shifting of sheets or layers during descent into a carton or a like receptacle therebelow, deformation of corners of the stacks during gravitational descent into receptacles and/or the inability of stacks to enter the receptacles therebelow owing to inward or outward bulging of the side walls of receptacles in conventional apparatus and attendant inward movement of the corner portions of such receptacles.

It has been found that the improved apparatus can be used with equal advantage for processing of stacks which are assembled of very small, small, medium-sized, large or very large sheets. This does not apply for conventional apparatus which are likely to malfunction during introduction of stacks consisting of superimposed large or very large sheets, especially if the rate of filling of receptacles is reasonably high.

The extent of automation of the improved apparatus can be selected practically at will. Thus, in their simplest form, the apparatus can be provided with a series of knobs or analogous actuating elements which are operated by an attendant in the desired sequence to ensure that various components of the apparatus are started and arrested in the desired sequence. Alternatively, the apparatus can be furnished with more or less automatic control systems which use proximity detectors, mechanical sensors, photoelectric cells and/or other monitoring and signal generating means to automatically initiate one or more operations as soon as the preceding step is completed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

I claim:

1. A method of introducing substantially unsupported stacks of superimposed sheets of paper or the like including a lowermost sheet into cartons or analogous receptacles of the type having a bottom wall and several upstanding side walls which define an opening extending at least close to the respective bottom wall, one of said side walls being located opposite said opening in such a manner so as not to deform said stacks or otherwise shift the sheets thereof, said method comprising the steps of conveying successive receptacles to a predetermined location; feeding a stack into each of the receptacles at said location while supporting said stack from below through the opening by introducing said stack into each receptacle along a horizontal path at such a level above its bottom wall that the lowermost sheet of the stack approaching said location is disposed only slightly above the respective bottom wall; advancing said stack into such receptacle until such stack contacts said side wall opposite said opening causing said opposite side wall to contact a stop and actuate a sensing device which causes a signal to be transmitted to arrest the advance of said stack and cause the stack to be deposited in the receptacle with such lowermost sheet coming to rest on the respective bottom wall by descending a short distance prior to coming in contact with the bottom wall of the receptacle; and thereupon closing the opening.

2. The method of claim 1, wherein said feeding step includes depositing each stack on the bottom wall of the respective receptacle at least substantially without any gravitational descent of the stack toward such bottom wall.

3. The method of claim 1 of introducing stacks into receptacles of the type having three upstanding side walls and a fourth side wall which is located at the level of or below the bottom wall prior to feeding of a stack into the receptacle, the opening being located above the fourth side wall and said closing step including pivoting the fourth side wall upwardly upon completion of said feeding step.

4. The method of claim 1, further comprising the step of converting flat blanks into prefabricated receptacles of the type having a bottom wall and four side walls including three upstanding side walls at one side of said bottom wall and a fourth side wall in the plane of or at the other side of said bottom wall, said converting step preceding said advancing step and said advancing step including positioning successive prefabricated receptacles at said location in such orientation that the bottom walls of such receptacles are located in substantially horizontal planes.

5. The method of claim 4, further comprising the step of removing filled receptacles from said location prior to said closing step.

6. The method of claim 1 of introducing stacks into receptacles of the type having three upstanding side walls and a fourth side wall located at the level of or below the bottom wall prior to feeding of stacks into such receptacles, the openings being located above the fourth side walls.

7. The method of claim 1, further comprising the step of removing a filled receptacle from said location prior to said closing step.

8. The method of claim 7 of introducing stacks into receptacles of the type having three upstanding side walls and a fourth side wall located at the level of or below the bottom wall prior to feeding of stacks into such receptacles, the openings being located above the fourth side wall and further comprising the steps of holding each fourth side wall against movement to a position in which the fourth side wall closes the respective opening in the course of said feeding step, and pivoting the fourth side wall to a position in which the fourth side wall closes the respective opening in automatic response to removal of a filled receptacle from said location.

9. The method of claim 1, wherein the receptacles are cartons made of cardboard and said feeding step includes advancing the stacks along a substantially horizontal path toward and into the receptacles at said location.

10. Apparatus for introducing substantially unsupported stacks of paper sheets or the like into prefabricated cartons or analogous receptacles of the type having a bottom wall and several upstanding side walls which define an opening extending at least close to the bottom wall, one of said side walls being located opposite said opening, in such a manner so as not to deform said stack or otherwise shift the sheets thereof said apparatus comprising means for conveying including means for intermittently conveying a series of receptacles along a first path so that successive receptacles of said series assume a predetermined position during successive intervals of dwell of said series and the opening of the receptacle in said predetermined position faces in a predetermined direction; a transfer unit including means for feeding successive stacks of a series of stacks along a second path which terminates in the interior of the receptacle occupying said position, said second path being located slightly above the bottom wall of the receptacle and extending through the opening of the receptacle in said pretermined position so that said feeding means can deliver each stack into the interior of the respective receptacle until said stack contacts the side wall opposite the opening causing the opposite side wall to contact a stop; and sensing means adapted to sense the contact between said opposite side wall and said stop, said sensing means adapted to transmit a signal to said transfer unit when said opposite side wall contacts said stop and cause said feeding means to deposit said stack in said receptacle.

11. The apparatus of claim 10, further comprising means for supplying stacks of sheets to said feeding means.

12. The apparatus of claim 11, wherein said supplying means comprises first and second stack-delivering tracks.

13. The apparatus of claim 12 for introducing stacks into receptacles of the type having three upstanding side walls and a fourth side wall below the respective opening, further comprising means for maintaining the fourth side wall of a receptacle which is advanced to and dwells at said predetermined position at the level of or below the respective bottom wall, and means for moving the fourth side walls of successive receptacles to a level above the corresponding bottom walls so that the thus moved fourth side walls close the openings of the filled receptacles.

14. The apparatus of claim 12, further comprising an intermediate conveyor operative to alternately advance stacks from said first and second tracks to said feeding means.

15. The apparatus of claim 12, wherein said feeding means comprises endless flexible conveyor means having a stack-supporting reach and means for shifting said conveyor means into and from the receptacle in said predetermined position.

16. The apparatus of claim 15, wherein said feeding means further comprises rotary members and said endless conveyor means is trained over said rotary members.

17. The apparatus of claim 16, wherein said shifting means includes means for moving at least one of said rotary members between a first position in the interior of the receptacle at said predetermined position and a second position outside of such receptacle, and further comprising means for holding said endless conveyor means against sliding movement relative to the stack in the interior of the receptacle in said position during movement of said one rotary member to said second position so that no friction develops between the conveyor means and the stack in the freshly filled receptacle during retraction of the one rotary member from such receptacle.

18. The apparatus of claim 17, wherein said rotary members include a front rotary member which is nearer to said predetermined position and a rear rotary member more distant from said predetermined position, said front rotary member constituting said one rotary member and further comprising frame means and means for rotatably mounting said rear rotary member in said frame means.

19. The apparatus of claim 18, further comprising means for tensioning said endless conveyor means.

20. The apparatus of claim 19, wherein said tensioning means comprises additional rotary members including a first additional rotary member rotatable in said frame means about a fixed axis and a second additional rotary member which shares the movements of said one rotary member into and from the receptacles occupying said predetermined position.

21. The apparatus of claim 20, wherein said additional rotary members constitute a means for looping a portion of said endless conveyor means, the size of such looped portion increasing while said one rotary member is moved to said second position and decreasing while said one rotary member is moved to said first position.

22. The apparatus of claim 21, wherein said endless conveyor means includes an elongated reach between said first mentioned rotary members and the length of said reach increases when the size of said looped portion decreases and vice versa.

23. The apparatus of claim 22, further comprising means for moving said endless conveyor means so as to advance successive increments of said reach in a direction toward said predetermined position, said means for holding including means for arresting said moving means during movement of said one rotary member from said first to said second position.

24. The apparatus of claim 17, wherein said shifting means includes a reciprocable carriage and further comprising guide means for said carriage.

25. The apparatus of claim 24, wherein said one rotary member is mounted on and is reciprocable with said carriage.

26. The apparatus of claim 24, wherein said shifting means further comprises a rotary drive shaft and means for transmitting motion from said drive shaft to said carriage.

27. The apparatus of claim 26, wherein said motion transmitting means comprises an eccentric driven by said shaft and a linkage coupling said eccentric with said carriage.

28. The apparatus of claim 12, wherein said feeding means includes a stack supporting platform and means for shifting said platform between a first position in which a stack on said platform is disposed in the interior of the receptacle occupying said predetermined position and a second position in which said platform is located outside of such receptacle.

29. The apparatus of claim 28, further comprising means for separating receptacles from said platform in response to shifting of said platform from said first to said second position.

30. The apparatus of claim 29, wherein said platform is shiftable along said second path and said second path is elongated, said platform having a stack supporting upper side and at least one recess provided in said upper side to reduce the area of contact between such upper side and a stack on said platform.

31. The apparatus of claim 30, wherein said recess is an elongated slot which is substantially parallel to the longitudinal direction of said second path.

32. The apparatus of claim 29, wherein said platform includes a leader and further comprising a frame for said platform and rotary means provided on the upper side of said platform in the region of said leader.

33. The apparatus of claim 29, further comprising means for establishing and maintaining a cushion of gaseous fluid between said platform and the stack thereon during movement of said platform from said first to said second position.

34. The apparatus of claim 33, wherein said platform has a stack-supporting upper side and said means for establishing and maintaining comprises at least one orifice provided in said upper side, a source of compressed gaseous fluid, and means for connecting said source with said orifice.

35. The apparatus of claim 29, further comprising a frame movably supporting said platform and friction-reducing means on said platform.

36. The apparatus of claim 14, wherein said tracks flank said feeding means.

37. The apparatus of claim 36, wherein said second path is elongated and said intermediate conveyor comprises a yoke movable transversely of said second path between a first end position in which it overlies said feeding means and said first track and a second end position in which it overlies said feeding means and said second track, said yoke having means for respectively transferring a stack from said first and second tracks onto said feeding means during movement to said second and first end positions.

* * * * *